US007163436B2

(12) United States Patent
Hösel

(10) Patent No.: US 7,163,436 B2
(45) Date of Patent: Jan. 16, 2007

(54) APPARATUS AT A SPINNING ROOM MACHINE, ESPECIALLY A FLAT CARD, ROLLER CARD, CLEANER OR THE LIKE, FOR PROCESSING, ESPECIALLY GRINDING AND/OR SHARPENING, A CLOTHING

(75) Inventor: Fritz Hösel, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 11/299,763

(22) Filed: Dec. 13, 2005

(65) Prior Publication Data

US 2006/0128270 A1 Jun. 15, 2006

(30) Foreign Application Priority Data

Dec. 15, 2004 (DE) ..... 10 2004 060 663

(51) Int. Cl.
*B24B 19/18* (2006.01)

(52) U.S. Cl. ..... 451/5; 451/28; 451/416

(58) Field of Classification Search ..... 451/5, 451/11, 28, 56, 416, 417, 49, 162, 423, 426, 451/164

See application file for complete search history.

(56) References Cited

U.S. PATENT DOCUMENTS 3,214,868 A * 11/1965 Riley ..... 451/347
4,327,525 A * 5/1982 Ennis ..... 451/416
5,355,560 A * 10/1994 Fritzsche et al. ..... 19/98
5,797,788 A * 8/1998 Graf et al. ..... 451/28
5,894,636 A 4/1999 Sauter et al.
6,106,381 A 8/2000 Leder et al.
6,863,591 B1 * 3/2005 Graf ..... 451/28

FOREIGN PATENT DOCUMENTS

DE 32 18 114 C2 12/1982
DE 240 569 A1 11/1986
DE 43 19 631 C2 12/1994
DE 102 58 789 A1 7/2004
EP 1215312 A1 6/2002

OTHER PUBLICATIONS

British Search Report—GB0525043.6, dated Apr. 7, 2006.

* cited by examiner

*Primary Examiner*—Lee D. Wilson
*Assistant Examiner*—Anthony Ojini
(74) *Attorney, Agent, or Firm*—Venable LLP; Robert Kinberg; Ryan M. Flandro

(57) ABSTRACT

In a spinning room machine, especially a flat card, roller card or cleaner, an apparatus for processing, especially grinding and/or sharpening, a clothing on a roller has a processing device which is movable along a track. The spinning room machine has an electronic control and regulation device together with a drive control, which is used for controlling the speed of rotation of the processing device. In order to control and/or regulate all functions of or for the processing device using means that are simple in terms of equipment, control and/or regulation of or for the processing device is integrated into the control and regulation device of the spinning room machine, functional elements of or for the processing device and the control and regulation device of the spinning room machine being capable of exchanging signals.

20 Claims, 4 Drawing Sheets

Fig. 2
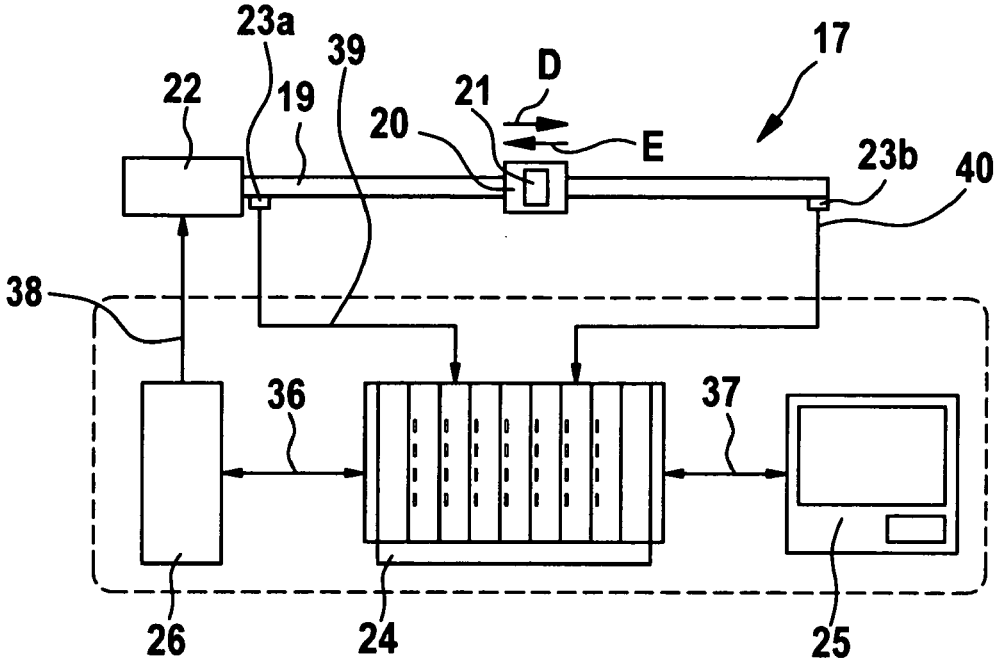
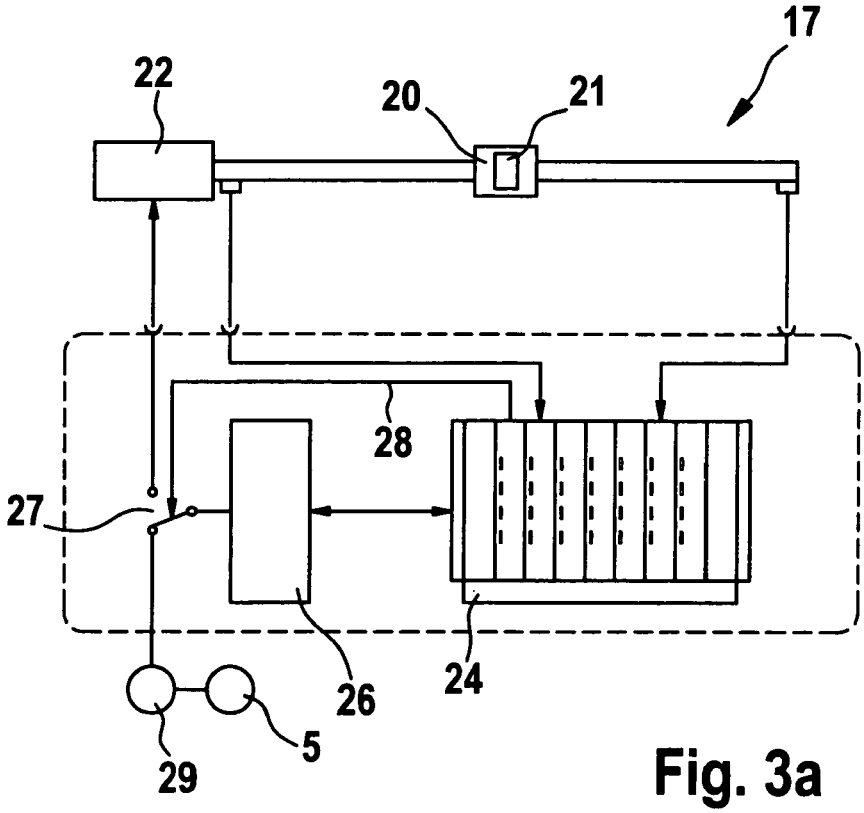
Fig. 3a

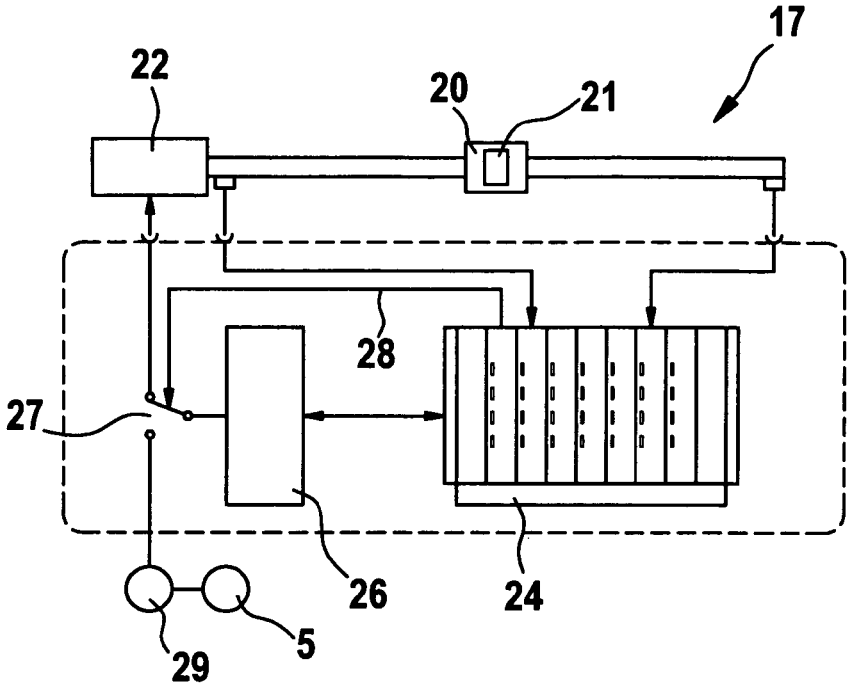
Fig. 3b
Fig. 4
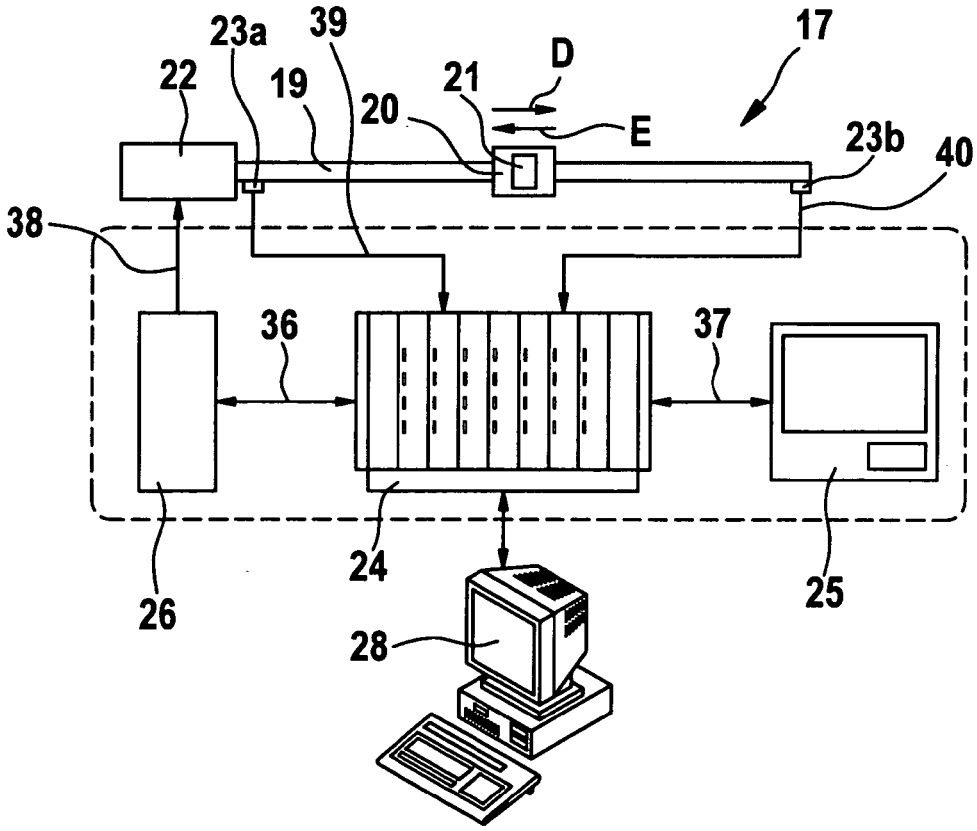

APPARATUS AT A SPINNING ROOM MACHINE, ESPECIALLY A FLAT CARD, ROLLER CARD, CLEANER OR THE LIKE, FOR PROCESSING, ESPECIALLY GRINDING AND/OR SHARPENING, A CLOTHING

CROSS REFERENCE TO RELATED APPLICATION

This application claims priority from German Patent Application No. 10 2004 060 663.3 dated Dec. 15, 2004, the entire disclosure of which is incorporated herein by reference.

BACKGROUND OF THE INVENTION

The invention relates to an apparatus at a spinning room machine, especially a flat card, roller card, cleaner or the like, for processing, especially grinding and/or sharpening, a fibre processing clothing drawn onto a roller, especially a sawtooth all-steel clothing.

In the textile machine sector, especially in the case of flat cards and roller cards, the clothings with which the individual rollers, for example the cylinder or doffer, are equipped have to be ground or re-sharpened at regular intervals. This procedure is necessary because the clothings are subject to considerable wear during carding, and the result of carding is adversely affected by blunt clothings. Clothings can, as a rule, be re-sharpened a number of times, after which they have to be replaced. Special devices exist for the grinding procedure, which usually consist of a traversing device having a grinding head, an electric motor as the drive for the device, a control device with operating elements, and a transport carriage. In addition, the flat card or roller card control system usually has specific service programs for these grinding procedures. For the purpose, it is basically necessary to by-pass safety interlocks that are imperative in normal production and to rotate the rollers to be ground at, for example, other pre-determined speeds of rotation. In some cases, the directions of rotation also have to be changed. As a result of the fact that the grinding devices require their own separate control system, they are relatively expensive.

A processing arrangement may be movable along a track, wherein the spinning room machine has an electronic control and regulation device together with a drive control, which is used for controlling the speed of rotation of the processing arrangement. In the case of a known apparatus (DD 240 569 A1), a drive system for flat cards or roller cards is provided with at least one speed-controlled three-phase current motor, with which there is associated a speed control device. The speed of rotation of each three-phase current motor can be controlled using a frequency converter. Associated with each of the two frequency converters is a separate microcomputer (MR 1 and MR 2). Each frequency converter can be controlled, via a D/A converter, by a microcomputer, in the RAM memory of which there are stored speed control program blocks for all-steel clothing grinding procedures. The two microcomputers operate according to the master/slave principle, that is to say they are dependent on one another and their various tasks are divided up amongst them. Data exchange between the microcomputers is carried out via coupling amplifiers and a coupling bus. The speed control program blocks for all-steel clothing grinding procedures serve exclusively for the purpose of controlling the speed of the three-phase current motors. A disadvantage, amongst others, in the case of that apparatus is that modifying the grinding procedure is not possible, as can be necessary, for example, in the event of changes in loading. In addition, the equipment outlay is considerable as a result of the fact that two microcomputers are required.

It is an aim of the invention is to provide an apparatus of the kind mentioned at the beginning that avoids or mitigates the mentioned disadvantages and that especially is capable of controlling and/or regulating all functions of or for the processing arrangement using means that are simple in terms of equipment.

SUMMARY OF THE INVENTION

The invention provides a spinning room machine including an apparatus for processing a clothing on a roller, the processing apparatus having a plurality of functional elements comprising:

a processing device; and a track along which the processing device is movable;

wherein the spinning room machine further comprises a control and regulation device for control and regulation of the spinning room machine, the control and/or regulation of the processing device is integrated into the control and regulation device for the spinning room machine, and at least one said functional element of the processing apparatus and the control and regulation device of the spinning room machine are so arranged that passage of data therebetween is able to take place.

In accordance with the invention, provision is made for the electronic control and regulation device (together with the drive control) of the spinning room machine to be used for control and/or regulation of all functions of or for the processing arrangement. The grinding device control is directly integrated into the control system of the flat card or roller card and, for the operation thereof, the operating and display unit of the spinning room machine is preferably used. All sensors and actuators of the device are, when required, connected to the machine control, for example by means of a plug connection. The machine software also comprises specific "grinding programs". In the course thereof, certain safety devices are rendered ineffective, the rollers in question are driven and the full functionality of the grinding device is put into practice. A particular advantage is that a separate control system for each grinding device is dispensed with entirely. As a result of that measure alone very considerable cost reductions can be achieved. As a result of the integration of the control of the grinding device into that of the spinning room machine, data arising during grinding can, in addition, be determined, stored and, when required, retrieved. The mechanic or foreman in question is thereby saved the task of manually keeping corresponding documentation. In addition, the data required for the machine in question are available at all times where most frequently needed, that is to say directly at the machine.

The apparatus according to the invention makes possible further technical and technological improvements. Instead of, for example, two traversing speeds, stepless modification thereof is possible. For modifying the speed of the motor for the traversing movement the speed control or regulation device provided in the card control system is advantageously used. Because a large proportion of the speed-regulated or speed-controlled drives present are not used during the grinding procedure, it is not a problem for such a device to be switched over and, therefore, utilised twice. The machine control is preferably so arranged that the number of grinding procedures and also data arising during the procedures in question are determined and stored and are retrievable at any time. The data can be the speeds of rotation used, the number of traversing movements, the magnitude of the infeed or the like. In addition, the data can be shown in a clear manner on the machine display, transferred to other systems (for example, KIT) or printed out. In dependence on the amount of sliver actually produced since drawing-on or since the last grinding procedure, it is possible for information relating to necessary grinding procedures to be automatically outputted in the individual machines in question. It is thereby possible to prevent such measures from being forgotten (clothing management). For example, as soon as the control determines that a grinding or replacement procedure is necessary for the machine in question, this can be displayed, using the signal lamp on the machine, in a manner that is clearly visible from afar. The connection between the grinding device and the machine control is preferably made by means of correspondingly suitable plug connections.

Advantageously, the machine software comprises programs which control and monitor the grinding device and the requisite rollers during the grinding process. Advantageously, the machine control is so arranged that safety devices which are imperative for operation during production are taken out of operation for the grinding process. Advantageously, the traversing speed of the grinding head is steplessly adjustable. Advantageously, a drive control or regulation device already present in the flat card or roller card control system is used for control or regulation of the traversing drive motor. Advantageously, the drive control or regulation device can be switched over. Advantageously, the grinding device is arranged to be coupled to the flat card or roller card with the aid of plug connections. Advantageously, the machine control system is so arranged that the number of grinding passes or grinding procedures and other data arising in the process are determined, are arranged to be stored and are retrievable at any time. Advantageously, the data arising are the speeds of rotation used, the number of traversing movements, the magnitude of the infeed or the like. Advantageously, the data determined are shown in clear form on the machine display. Advantageously, the data determined can be transferred to other systems (for example, KIT) or machines and/or printed out. Advantageously, operation during the grinding procedure is carried out by means of the operating and display device of the flat card or roller card. Advantageously, the speed of rotation control device is integrated into the electronic machine control and regulation device. Advantageously, the speed of rotation control device is integrated into the electronic motor control and regulation device. Advantageously, the operating device of the spinning room machine is used for operation of the processing arrangement. Advantageously, the display device of the spinning room machine is used. Advantageously, the operator receives instructions, messages, information and the like by way of the display device before, during and after grinding. Advantageously, for driving a roller being ground, there is used a drive motor of the carding machine, which drive motor is provided for driving another roller during production. Advantageously, the other roller is a roller of the carding machine. Advantageously, the doffer motor is used for driving the cylinder during the grinding process. Advantageously, the necessary functions for grinding the clothings, especially driving the roller being ground, are carried out by means of the control system of the spinning room machine, for example of the flat card or roller card. Advantageously, in the control and regulation apparatus there is provided a specific program for the grinding process, which is started when required.

Advantageously, the actuator is a motor. Advantageously, the actuator drives a device for traverse of the grinding element. Advantageously, the actuator is a device for infeed of the grinding element towards and away from the clothing to be ground, for example, a motor or a, preferably double-acting, pneumatic cylinder. Advantageously, the function element is a sensor. Advantageously, the sensor ascertains the end position of the traversing grinding element. Advantageously, the arrangement is such that the direction of travel is reversed at end positions of the travel path. Advantageously, the processing arrangement comprises a grinding element, for example a grinding stone. Advantageously, during the grinding procedure, the grinding stone is biased against the clothing, for example by means of a spring. Advantageously, the grinding element is a rotating grinding disc. Advantageously, the control and regulation device of the spinning room machine is connected to at least one switching element associated with the processing arrangement, as a result of the actuation of which switching element modification of the processing arrangement along the predetermined track and/or an infeed movement can be initiated.

The invention also provides an apparatus at a spinning room machine, especially a flat card, roller card, cleaner or the like, for processing, especially grinding and/or sharpening, a fibre processing clothing drawn onto a roller, especially a sawtooth all-steel clothing, having a processing arrangement which is movable along a track, wherein the spinning room machine has an electronic control and regulation device together with a drive control, which is used for controlling the speed of rotation of the processing arrangement, wherein control and/or regulation of or for the processing arrangement is integrated into the control and regulation device of the spinning room machine, the function elements of or for the processing arrangement, especially actuators and the like, and the control and regulation device of the spinning room machine being capable of exchanging signals unidirectionally and/or bidirectionally.

BRIEF DESCRIPTION OF THE DRAWINGS

FIG. 2 is a diagrammatic side view of a grinding device having a traversing drive and with a block circuit diagram comprising an electronic machine control and regulation device, an electronic motor control and/or regulation device and an operating and display device;

FIGS. 3*a*, 3*b* are diagrammatic side views of a further grinding device according to the invention, with block circuit diagrams comprising an electronic machine control and regulation device and an electronic motor control and/or regulation device with a switch-over device which is capable of switching over between the doffer drive (FIG. 3*a*) and the traversing drive (FIG. 3*b*);

FIG. 4 shows a further embodiment of grinding device with a block circuit diagram, wherein the electronic machine control and/or regulation device is in communication with a KIT system;

DETAILED DESCRIPTION OF PREFERRED EMBODIMENTS

Figure 1:
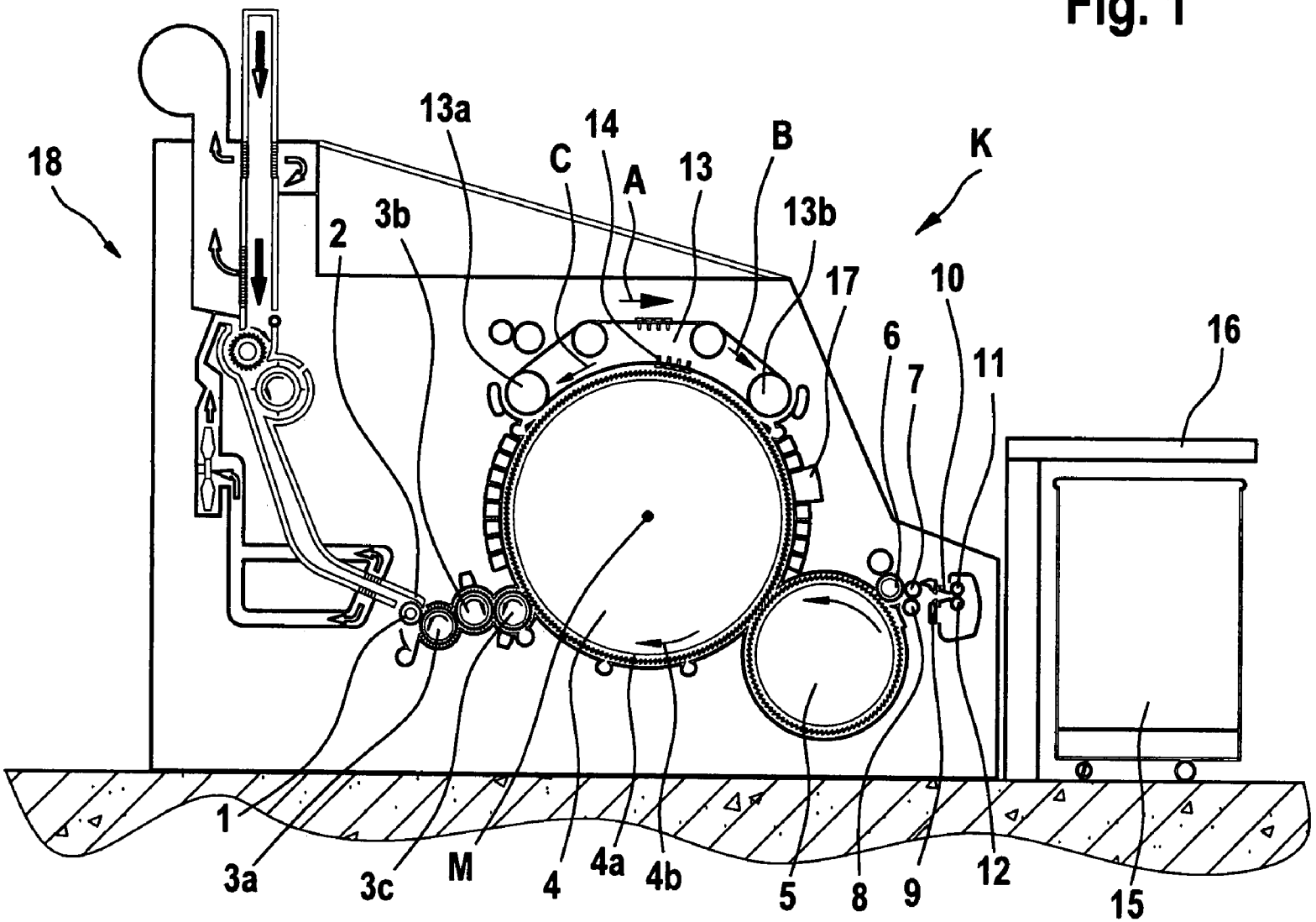
FIG. 1 shows, in a diagrammatic side view, a flat card which may incorporate an apparatus according to the invention.

With reference to FIG. 1, a flat card K, for example a TC 03 flat card made by Trützschler GmbH & Co. KG of Mönchengladbach, Germany, has a feed roller 1, feed table 2, lickers-in 3*a*, 3*b*, 3*c*, cylinder 4, doffer 5, stripper roller 6, nip rollers 7, 8, web-guiding element 10, draw-off rollers 11, 12, revolving card top 13 having card-top-deflecting rollers 13*a*, 13*b* and card top bars 14, can 15 and can coiler 16. Curved arrows denote the directions of rotation of the rollers. Reference letter M denotes the centre (axis) of the cylinder 4. Reference numeral 4*a* denotes the clothing and reference numeral 4*b* denotes the direction of rotation of the cylinder 4. Reference letter C denotes the direction of rotation of the revolving card top 13 at the carding location and reference letter B denotes the direction in which the card top bars 14 are moved on the reverse side. Reference numeral 17 denotes a grinding device for the clothing 4*a* of the cylinder 4 and reference numeral 18 denotes a card feeder.

In accordance with FIG. 2, a first embodiment of the grinding device 17 comprises a straight guide rail 19 and a grinding head 20 provided with a grinding stone 21, which grinding head is capable of moving (traversing) along the guide rail 19 in the direction of arrows D, E, and also comprises an infeed device (not shown). The straight guide rail 19 is arranged axially parallel to the axis M and to the clothed outer surface of the cylinder 4. The grinding device 17 further comprises a drive device 22, by means of which the grinding head 20, together with the grinding stone 21, can be moved along the guide rail 19 in direction D, E. The infeed device comprises at least one infeed element, by means of which the grinding head 20, together with the grinding stone 21, is moved perpendicular to the guide rail 19 from a waiting position into the grinding position and back. The infeed element is advantageously in the form of a double-acting pneumatic lifting cylinder, which is preferably controlled by the electronic control and regulation device 24. A positioning motor can also be advantageously used. The infeed device has a biasing device (not shown), for example a spring-loaded biasing device, which during the grinding procedure serves to automatically guide the grinding stone in a contact-making direction. The start and end points (reversing points) of the grinding region are defined by two sensors 23*a*, 23*b*. An electronic machine control and regulation device 24 (card control), for example a TMS 2 made by Trützschler GmbH & Co. KG, is provided. Connected to the machine control and regulation device 24 are an operating and display device 25, a drive control and/or regulation device 26 and the sensors 23*a*, 23*b*. The drive control and/or regulation device 26 is in communication with the drive unit 22 (traversing drive), which preferably comprises an electric drive motor.

The electronic control and regulation device 24 is connected, by way of lines 36, 37, 38, 39, 40 and/or by wireless means to the drive control and/or regulation device 26, to the operating and display device 25, to the drive device 22 and to the sensors 23*a*, 23*b*. This brings about unidirectional and/or bidirectional exchange of signals between the function elements of the grinding device 17 and the electronic control and regulation device 24.

In the embodiment of FIGS. 3*a*, 3*b*, there is a switch-over device 27 arranged between the drive control and/or regulation device 26 and the drive motor 29 for the doffer 5, on the one hand, and the drive device 22 for the traversing movement of the grinding device 17, on the other hand. The switch-over device 27 is controlled, by way of a line 28, by the machine control and regulation device 24. The switch-over device 27 makes the connection from the drive control and/or regulation device 26 to the drive motor 29 for the doffer 5, when in the position according to FIG. 3*a*, and to the drive control 22 for the traversing movement of the grinding device 17, when in the position according to FIG. 3*b*.

The embodiment of FIG. 4 corresponds to the arrangement shown in FIG. 2, except that the electronic control and regulation device 24 being connected to a KIT card information system.

Figure 5A:
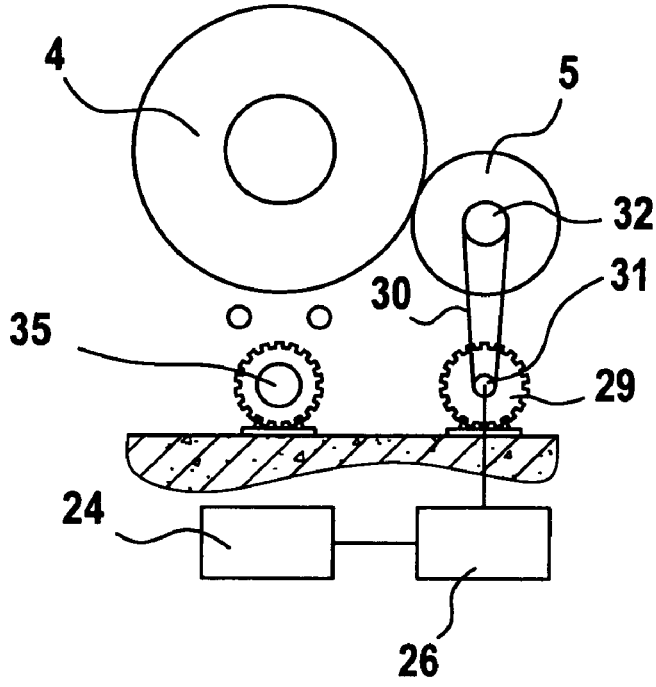
FIG. 5*a* is a side view of a speed-controlled drive motor for the doffer during production by the doffer of the flat card according to FIG. 1.
Figure 5B:
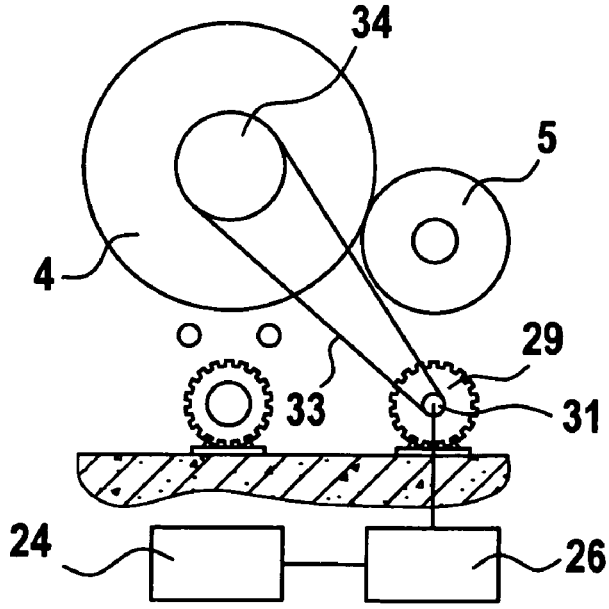
FIG. 5*b* shows the speed-controlled drive motor for the doffer according to FIG. 5*a* during grinding of the clothing of the cylinder.

The arrangement shown in FIGS. 5*a*, 5*b*, the speed-controlled motor 29 is associated with the doffer 5. During production by the carding machine K, the motor 29 drives the doffer 5 by way of the belt 30 (see FIG. 5*a*). The belt 30 loops around the belt pulleys 31 and 32. During grinding of the clothing 4*a* of the cylinder 4, the motor 29 drives the cylinder 4 by means of another belt 33 (see FIG. 5*b*). The belt 33 loops around the belt pulleys 31 and 34.

By that means, a motor already present in the machine K and equipped with speed control is used for driving the rollers during the grinding process at the customer's premises. That motor can be a motor which is in any case present for the production area of the roller in question. It is advantageous for the doffer motor 24, which is provided as standard with highly accurate speed control, to be used for grinding of the cylinder 4. For that purpose it is merely necessary to remove the drive belts between the doffer motor 29 and the doffer 5 and between the cylinder motor 35 and the cylinder 4 and to fit a belt or the like between the doffer motor 29 and the cylinder 4 (FIG. 5*b*). The machine is so constructed mechanically that a transmission of such a kind is possible and corresponding belt pulleys of the correct size and kind are already present. By that means it is possible, very simply, rapidly and with only minimal outlay, to produce the drive for grinding of the rollers.

By means of the device according to the invention, the control of the grinding device is directly integrated into that of the flat card or roller card and, for the operation thereof, the operating and display unit of the machine is used. All sensors and actuators of the device are, when required, connected to the machine control, for example by means of a plug connection. The machine software also comprises specific grinding programs. In the course thereof, particular safety devices are firstly rendered ineffective, the rollers in question are driven and the full functionality of the grinding device is put into practice.

Use of the apparatus according to the invention results in the particular advantage that a separate control system for the grinding device can be dispensed with entirely. As a result of that measure alone, very considerable cost reductions can be achieved.

Although the foregoing invention has been described in detail by way of illustration and example for purposes of understanding, it will be obvious that changes and modifications may be practised within the scope of the appended claims.

What is claimed is:

1. A spinning room machine including an apparatus for processing a clothing on a roller, the processing apparatus having a plurality of functional elements comprising:

a processing device; and a track along which the processing device is movable;

wherein the spinning room machine further comprises a control and regulation device for control and regulation of the spinning room machine, the control and/or regulation of the processing device is integrated into the control and regulation device for the spinning room machine, and at least one said functional element of the processing apparatus and the control and regulation device of the spinning room machine are so arranged that passage of data therebetween is able to take place.

2. A spinning room machine according to claim 1, in which the arrangement is such that unidirectional passage of data is possible between said at least one functional element and the control and regulation device of the spinning room machine.

3. A spinning room machine according to claim 1, in which the arrangement is such that bidirectional exchange of data is possible between said at least one functional element and the control and regulation device of the spinning room machine.

4. A spinning room machine according to claim 1, in which the processing apparatus is a grinding device.

5. A machine according to claim 4, in which the machine software comprises programs which control and monitor the grinding device and the requisite rollers during the grinding process.

6. A machine according to claim 4, in which the traversing speed of a grinding head of the grinding device is steplessly adjustable.

7. A machine according to claim 4, characterised in that the machine control system is so arranged that the number of grinding passes or grinding procedures and other data arising in the process are determined, are arranged to be stored and are retrievable at any time.

8. A machine according to claim 4, in which the machine is a carding machine and, for driving a roller being ground, there is used a drive motor of the carding machine, which drive motor is provided for driving another roller during production.

9. A machine according to claim 8, in which a doffer motor of the machine is used for driving the doffer or a carding cylinder of the machine during the grinding process.

10. A machine according to claim 4, in which the necessary functions for grinding the clothings, including driving the roller being ground, are carried out by means of the control system of the spinning room machine.

11. A machine according to claim 4, in which the grinding device includes as a said functional element an actuator for driving a device for traverse of the grinding element.

12. A machine according to claim 4, in which the grinding device comprises as a functional element an actuator for infeed of the grinding element towards and away from the clothing to be ground.

13. A machine according to claim 4, in which the grinding device includes as a functional element a sensor for ascertaining the end position of a traversing element.

14. A machine according to claim 13, in which the arrangement is such that the direction of travel is reversed at end positions of the travel path.

15. A machine according to claim 4, in which the grinding device comprises a grinding stone or a rotating grinding disc.

16. A machine according to claim 1, in which the machine control is so arranged that safety devices which are in operation during fibre production are taken out of operation for the processing of the clothing.

17. A machine according to claim 1, in which the drive control or regulation device can be switched over between a drive device for a fibre processing roller and a drive device for the grinding device.

18. A machine according to claim 1, in which the speed of rotation control device is integrated into the electronic machine control and regulation device or into an electronic motor and regulation device.

19. A machine according to claim 1, in which the control and regulation device of the spinning room machine is connected to at least one switching element associated with the processing arrangement, as a result of the actuation of which switching element modification of the processing arrangement along the predetermined track and/or an infeed movement can be initiated.

20. A spinning room machine having a grinding device for grinding and/or sharpening a steel clothing having a grinding element which is movable along a track, and wherein the spinning room machine has an electronic control and regulation device together with a drive control, which is used for controlling the speed of rotation of the grinding element, in which control and/or regulation of or for the grinding device is integrated into the control and regulation device of the spinning room machine, whereby the control and regulation device of the spinning room machine and at least one functional element of the grinding device are arranged to be capable of exchanging signals unidirectionally and/or bidirectionally.

* * * * *